US005847652A

United States Patent [19]

Yamamoto

[11] Patent Number: 5,847,652

[45] Date of Patent: Dec. 8, 1998

[54] ELECTRONIC WHISTLE DEVICE

[76] Inventor: David Takao Yamamoto, 1245 Kaumana Dr., Hilo, Hi. 96720

[21] Appl. No.: 941,567

[22] Filed: Sep. 30, 1997

[51] Int. Cl.[6] ..... G08B 13/00

[52] U.S. Cl. ..... 340/574; 340/384.3; 340/693

[58] Field of Search ..... 340/404.1, 404.2, 340/404.3, 384.7, 384.3, 693, 692, 574; 455/100; 446/26, 28, 397, 408, 484

[56] References Cited

U.S. PATENT DOCUMENTS

| | | | |
|---|---|---|---|
| 1,946,781 | 2/1934 | Davidson | 340/574 X |
| 3,087,117 | 4/1963 | Mitchell | 455/100 X |
| 3,293,549 | 12/1966 | Patterson | 455/100 X |
| 3,440,635 | 4/1969 | Hull | 340/574 X |
| 4,041,394 | 8/1977 | Pate | 455/100 |
| 4,587,516 | 5/1986 | Hiraki | 340/574 X |
| 4,665,389 | 5/1987 | Clendening | 340/574 |
| 4,739,990 | 4/1988 | Aguirre et al. | 463/47.3 |
| 5,005,002 | 4/1991 | Halperin | 340/574 |
| 5,079,679 | 1/1992 | Chin-Fa | 362/102 |
| 5,629,679 | 5/1997 | Cranford et al. | 340/574 |

*Primary Examiner*—Thomas J. Mullen, Jr.
*Attorney, Agent, or Firm*—Michael I. Kroll

[57] ABSTRACT

An electronic whistle device (10) comprising a casing (12). A whistle producing circuit (14) is carried within the casing (12). A manually operated switch (16) is remote from the casing (12). An assembly (18) is for electrically connecting the manually operated switch (16) to the whistle producing circuit (14) within the casing (12). When the manually operated switch (16) is closed, the whistle producing circuit (14) will be activated to make a whistle sound (20).

22 Claims, 2 Drawing Sheets

Whistle Signal Generator
52
16
64
68
66
18
72
70
44
42
14
10
46

52
64
66
16
54
56
60
58
48
10
12
34
40
80
82
44
36
18
22
76
40
68
72
70
28
42
14
32
30
38
46

ELECTRONIC WHISTLE DEVICE

BACKGROUND OF THE INVENTION

1. Field of the Invention

The instant invention relates generally to alarm systems and more specifically it relates to an electronic whistle device. The electronic whistle device is powered by a battery to make a sound similar to an ordinary whistle, which can be used by a person who uses a whistle.

2. Description of the Prior Art

Numerous alarm systems have been provided in prior art. For example, U.S. Pat. No. 5,471,199 to Yuan; U.S. Pat. No. 5,556,003 to Johnson et al.; U.S. Pat. No. 5,563,574 to Hoover and U.S. Pat. No. 5,587,971 to Thinesen all are illustrative of such prior art. While these units may be suitable for the particular purpose to which they address, they would not be as suitable for the purposes of the present invention as heretofore described.

YUAN, ZHIPING

Personal Lockable Alarm Device

U.S. Pat. No. 5,471,199

An personal lockable alarm device may be lockably attached to either an ankle or a wrist to produce a loud noise when activated, and may not be deactivated or removed from the ankle or wrist until a code is entered into a locking mechanism of the device.

JOHNSON, DOUGLAS A. SABATES, III, FELICIANO S.

Hand-held Personal Defense Apparatus

U.S. Pat. No. 5,556,003

A hand-held personal defense apparatus for protecting a user against an attacker includes a hollow housing defining an elongate handgrip. An aerosol canister of a defense fluid, such as tear gas, MACE or (cayenne) pepper gas, and a battery-powered siren are positioned within the housing. The apparatus further includes a strike bar connected to the housing and extending forwardly in spaced relation from the handgrip so that the hand of the user may surroundingly grip the handgrip with the strike bar exposed on the outside of the hand. The strike bar serves as a visible deterrent to an attacker and may be used as a defensive weapon against the attacker. The apparatus further includes a movable actuator button for selectively activating the alarm or the alarm and the canister of defense fluid. The actuator button may be positioned in a safety position wherein the user cannot readily activate the alarm or the defense fluid. In a ready position the user can rotate the actuator button to activate the alarm, and can depress the actuator button to activate the alarm and the defense fluid simultaneously. In an alarm position wherein the alarm is activated, the user can depress the actuator button to activate the defense fluid. A companion exercise apparatus is also disclosed that includes a stop watch and a pedometer in place of the actuator button, a flashlight in place of the canister of defense fluid, and a storage compartment in place of the alarm.

HOOVER, DUSTIN A.

Electronic Sound Producing Game Animal Distraction Device for Use by a Hunter

U.S. Pat. No. 5,563,574

An electronic sound producing device for use by a hunter includes a transmitter mechanism for generating and transmitting into free space one of a plurality of radio signals and with the radio signal selectable by the hunter. A coupling mechanism is for securing the transmitter mechanism to a bow handle or a stock of a rifle. A remotely positionable receiver mechanism is for receiving the selected radio frequency signal and producing an audible sound with a pitch indicative of such signal.

THINESEN, TOM

Mode Preselect Function for a Multimode Electronic Timepiece

U.S. Pat. No. 5,587,971

A multimode electronic timepiece includes a display, a number of manually actuated switches, and an integrated circuit programed to keep time, to provide a plurality of operating modes, including time-of-day, in a continuous loop, and to permit an operator of the timepiece to cycle through the operating modes sequentially by selectively and repetitively actuating a first of the switches. The improvement includes at least one preselect function mode which displays information from a preselected operating mode along with information from another operating mode. The preselect function mode(s) is engaged by selective actuation of a second of the switches, and in the preferred embodiment, this switch is also used to cycle through the preselect function modes sequentially (where there is more than one preselect function mode). Upon actuation of another switch, the timepiece shifts between a preselect function mode and the operating mode, other than the preselected operating mode, having its information displayed by the preselect function mode.

SUMMARY OF THE INVENTION

A primary object of the present invention is to provide an electronic whistle device that will overcome the shortcomings of the prior art devices.

Another object is to provide an electronic whistle device that is battery powered to produce a sound similar to an ordinary whistle, which can be utilized by a person who uses a whistle, such as a sport referee, a coach and a police officer.

An additional object is to provide an electronic whistle device that will ease breathing, relieve stress on a mouth area and move a shrill whistle sound away from the ears of the person.

A further object is to provide an electronic whistle device that is simple and easy to use.

A still further object is to provide an electronic whistle device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DESCRIPTION OF THE PREFERRED EMBODIMENTS

Figure 1:
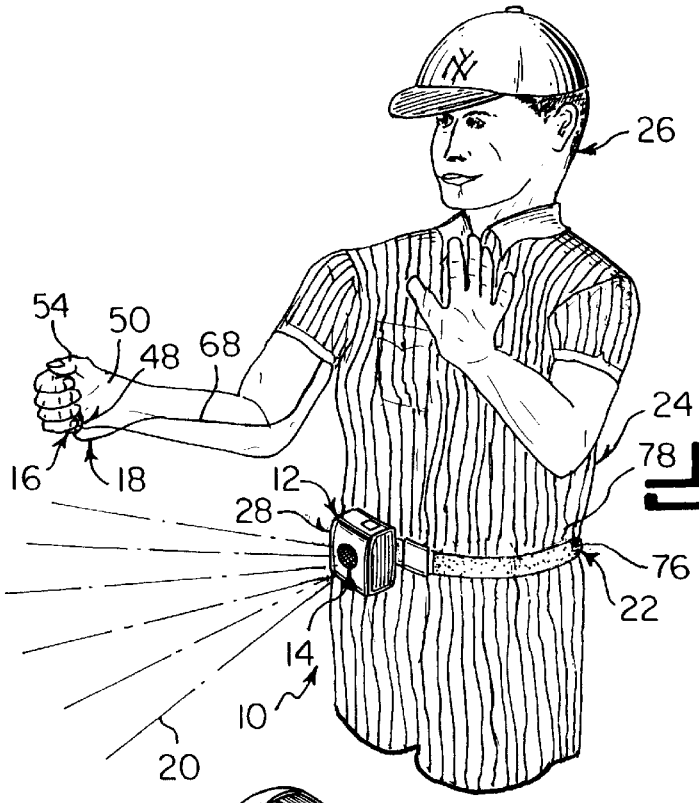
FIG. 1 is a perspective view of a person utilizing the present invention.
Figure 2:
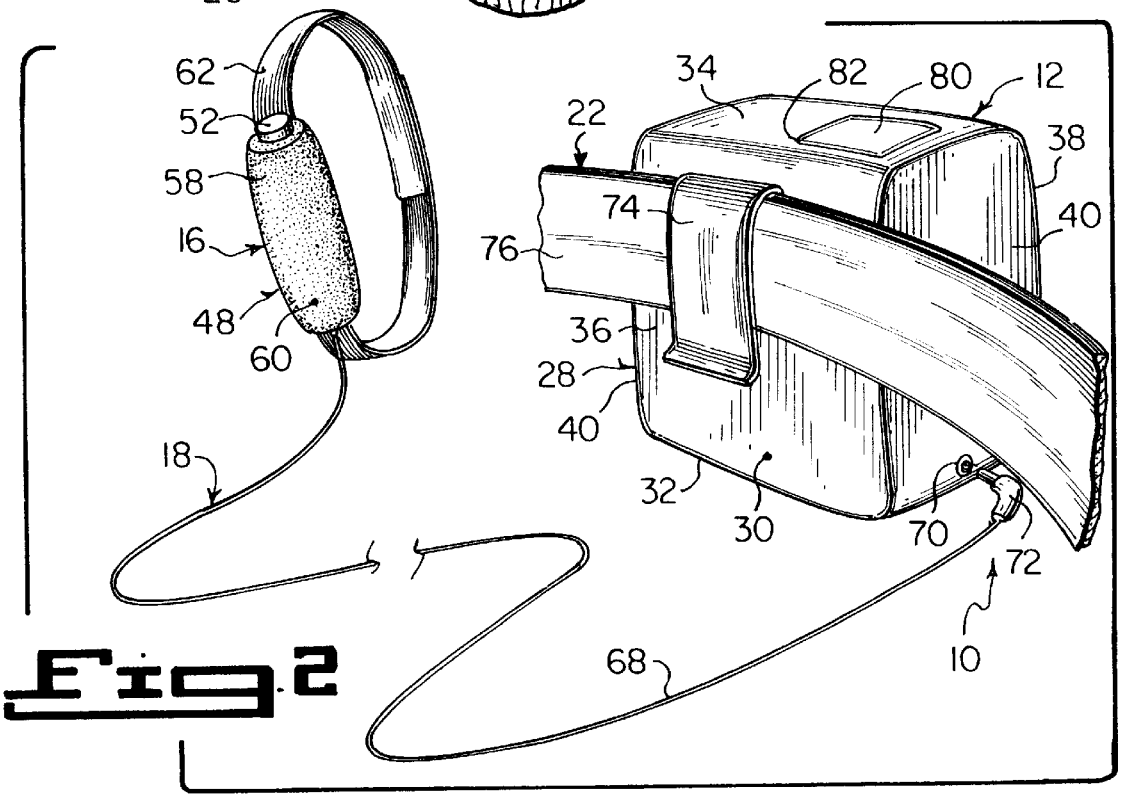
FIG. 2 is an enlarged rear perspective view of the present invention per se.
Figures 3, 4:
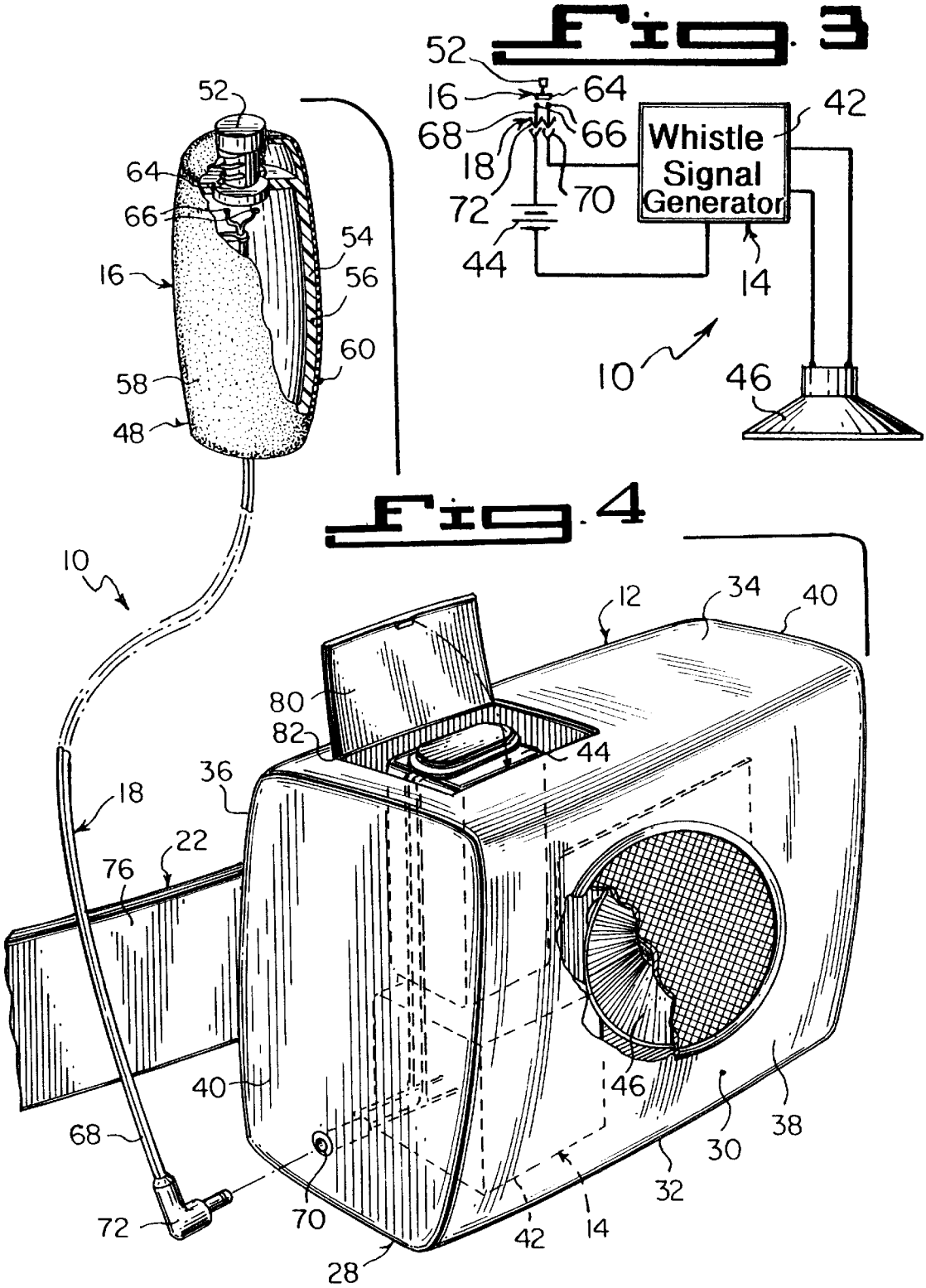
FIG. 3 is a schematic diagram of the electrical circuitry thereof.
FIG. 4 is a further enlarged front perspective view taken in the direction of arrow 4 in FIG. 2.

Turning now descriptively to the drawings, in which similar reference characters denote similar elements throughout the several views, FIGS. 1 through 4 illustrate the present invention being an electronic whistle device 10. With regard to the reference numerals used, the following numbering is used throughout the various drawing figures.

10 electronic whistle device
12 casing of 10
14 whistle producing circuit in 12 of 10
16 manually operated switch of 10
18 electrically connecting assembly of 10
20 whistle sound from 10
22 securing facility of 10
24 body of 26
26 person
28 hollow box for 12
30 rigid material of 28
32 bottom wall of 28
34 top wall of 28
36 rear wall of 28
38 front wall of 28
40 side wall of 28
42 whistle signal generator of 14
44 battery of 14
46 speaker of 14
48 hand grip of 16
50 hand of 26
52 spring biased plunger button of 16
54 inner elliptical shaped housing of 48
56 rigid material of 54
58 outer coating on 54 of 48
60 elastic substance of 58
62 strap of 48
64 movable electrically conductive plate of 52
66 stationary contact of 52
68 elongated wire of 18
70 jack of 18 in 12
72 plug of 18 on 68
74 spring clip of 22 on 12
76 belt of 22 on 78
78 waist on 24
80 access door of 10
82 hinge for 80 on 12

The electronic whistle device 10 comprises a casing 12. A whistle producing circuit 14 is carried within the casing 12. A manually operated switch 16 is remote from the casing 12. An assembly 18 is for electrically connecting the manually operated switch 16 to the whistle producing circuit 14 within the casing 12. When the manually operated switch 16 is closed, the whistle producing circuit 14 will be activated to make a whistle sound 20.

A facility 22 is for securing in a removable manner the casing 12 to a body 24 of a person 26. The person 26 can be a sport referee for football, basketball and other sports, a coach for all types of sports, a police officer and anyone else who uses a whistle. The casing 12 is a hollow box 28 formed of a rigid material 30.

The hollow box 28 contains a bottom wall 32 and a top wall 34. A rear wall 36 extends between the bottom wall 32 and the top wall 34. A front wall 38 extends between the bottom wall 32 and the top wall 34. A pair of side wall 40 extend between the bottom wall 32 and the top wall 34.

The whistle producing circuit 14 includes a whistle signal generator 42. A battery 44 is electrically connected to the whistle signal generator 42. A speaker 46 is also electrically connected to the whistle signal generator 42.

The manually operated switch 16 consists of a hand grip 48 to fit comfortably in a hand 50 of the person 26. A spring biased plunger button 52 is on one end of the hand grip 48, to be depressed by a thumb 54 on the hand 50 of the person 26. The hand grip 48 comprises an inner elliptical shaped housing 54 formed of a rigid material 56. An outer coating 58 is formed of an elastic substance 60 on the inner elliptical shaped housing 54. The hand grip 48 further includes a strap 62 attached thereto which wraps about the hand 50 of the person 26, so as to retain the hand grip 48 to the hand 50.

The spring biased plunger button 52 consists of a movable electrically conductive plate 64 carried on an inner end within the hand grip 48. A pair of spaced apart stationary contacts 66 are mounted within the hand grip 48 and electrically connected to the electrically connecting assembly 18. When the spring biased plunger button 52 is depressed, the plate 64 will engage with the contacts 66 to activate the whistle producing circuit 14.

The electrically connecting assembly 18 includes an elongated wire 68 having a first end electrically connected to the manually operated switch 16. A jack 70 mounted within the casing 12 is electrically connected to the whistle producing circuit 14. A plug 72 on a second end of the elongated wire 68 is inserted into the jack 70.

The securing facility 22 comprises a spring clip 74 affixed to the casing 12. A belt 76 is worn about a waist 78 on the body 24 of the person 26, so that the spring clip 74 can engage with the belt 76. An access door 80 is hinged at 82 to the casing 12 adjacent the battery 44. The battery 44 can be accessible for replacement, when the access door 80 is opened.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An electronic whistle device comprising:

a) a casing;

b) a whistle producing circuit carried within said casing;

c) a manually operated switch remote from said casing; and d) means for electrically connecting said manually operated switch to said whistle producing circuit within said casing, so that when said manually operated switch is closed said whistle producing circuit will be activated to make a whistle sound.

2. An electronic whistle device as recited in claim 1, further including means for securing in a removable manner said casing to a body of a person.

3. An electronic whistle device as recited in claim 2, wherein said casing is a hollow box formed of a rigid material.

4. An electronic whistle device as recited in claim 3, wherein said hollow box includes:

a) a bottom wall;

b) a top wall;

c) a rear wall extending between said bottom wall and said top wall;

d) a front wall extending between said bottom wall and said top wall; and e) a pair of side walls extending between said bottom wall and said top wall.

5. An electronic whistle device as recited in claim 4, wherein said whistle producing circuit includes:

a) a whistle signal generator;

b) a battery electrically connected to said whistle signal generator; and c) a speaker electrically connected to said whistle signal generator.

6. An electronic whistle device as recited in claim 5, wherein said manually operated switch includes:

a) a hand grip to fit comfortably in a hand of a person; and b) a spring biased plunger button on one end of said hand grip to be depressed by a thumb on the hand of the person.

7. An electronic whistle device as recited in claim 6, wherein said hand grip includes:

a) an inner elliptical shaped housing formed of a rigid material; and b) an outer coating formed of an elastic substance on said inner elliptical shaped housing.

8. An electronic whistle device as recited in claim 7, wherein said hand grip further includes a strap attached thereto which wraps about the hand of the person, so as to retain said hand grip to the hand.

9. An electronic whistle device as recited in claim 8, wherein said spring biased plunger button includes:

a) a movable electrically conductive plate carried on an inner end within said hand grip; and b) a pair of spaced apart stationary contacts mounted within said hand grip and electrically connected to said electrically connecting means, so that when said spring biased plunger button is depressed, said plate will engage with said contacts to activate said whistle producing circuit.

10. An electronic whistle device as recited in claim 9, wherein said electrically connecting means includes:

a) an elongated wire having a first end electrically connected to said manually operated switch;

b) a jack mounted within said casing and electrically connected to said whistle producing circuit; and c) a plug on a second end of said elongated wire to be inserted into said jack.

11. An electronic whistle device as recited in claim 10, wherein said securing means includes:

a) a spring clip affixed to said casing; and b) a belt worn about a waist on the body of the person, so that said spring clip can engage with said belt.

12. An electronic whistle device as recited in claim 11, further including an access door hinged to said casing adjacent said battery, so that said battery can be accessible for replacement when said access door is opened.

13. An electronic whistle device as recited in claim 1, wherein said casing is a hollow box formed of a rigid material.

14. An electronic whistle device as recited in claim 13, wherein said hollow box includes:

a) a bottom wall;

b) a top wall;

c) a rear wall extending between said bottom wall and said top wall;

d) a front wall extending between said bottom wall and said top wall; and e) a pair of side walls extending between said bottom wall and said top wall.

15. An electronic whistle device as recited in claim 1, wherein said whistle producing circuit includes:

a) a whistle signal generator;

b) a battery electrically connected to said whistle signal generator; and c) a speaker electrically connected to said whistle signal generator.

16. An electronic whistle device as recited in claim 1, wherein said manually operated switch includes:

a) a hand grip to fit comfortably in a hand of a person; and b) a spring biased plunger button on one end of said hand grip to be depressed by a thumb on the hand of the person.

17. An electronic whistle device as recited in claim 16, wherein said hand grip includes:

a) an inner elliptical shaped housing formed of a rigid material; and b) an outer coating formed of an elastic substance on said inner elliptical shaped housing.

18. An electronic whistle device as recited in claim 17, wherein said hand grip further includes a strap attached thereto which wraps about the hand of the person, so as to retain said hand grip to the hand.

19. An electronic whistle device as recited in claim 16, wherein said spring biased plunger button includes:

a) a movable electrically conductive plate carried on an inner end within said hand grip; and b) a pair of spaced apart stationary contacts mounted within said hand grip and electrically connected to said electrically connecting means, so that when said spring biased plunger button is depressed, said plate will engage with said contacts to activate said whistle producing circuit.

20. An electronic whistle device as recited in claim 1, wherein said electrically connecting means includes:

a) an elongated wire having a first end electrically connected to said manually operated switch;

b) a jack mounted within said casing and electrically connected to said whistle producing circuit; and c) a plug on a second end of said elongated wire to be inserted into said jack.

21. An electronic whistle device as recited in claim 2, wherein said securing means includes:

a) a spring clip affixed to said casing; and b) a belt worn about a waist on the body of the person, so that said spring clip can engage with said belt.

22. An electronic whistle device as recited in claim 15, further including an access door hinged to said casing adjacent said battery, so that said battery can be accessible for replacement when said access door is opened.

* * * * *